United States Patent [19]

Dunlap

[11] Patent Number: 4,802,928

[45] Date of Patent: Feb. 7, 1989

[54] DOCTORING APPARATUS AND METHOD EMPLOYING PRESTRESSED DOCTOR BLADE

[75] Inventor: Harold E. Dunlap, St. Petersburg, Fla.

[73] Assignee: Thermo Electron-Web Systems, Inc., Waltham, Mass.

[21] Appl. No.: 640,462

[22] Filed: Aug. 13, 1984

[51] Int. Cl.[4] ..... B08B 1/02

[52] U.S. Cl. ..... 134/15; 15/256.5; 15/256.51; 15/256.52; 15/256.53; 100/174; 241/112; 162/281; 162/99; 162/272; 210/396; 210/397; 118/652

[58] Field of Search ..... 15/256.5, 256.51, 256.52, 15/256.53; 134/6; 210/396, 397; 162/281, 99, 272; 100/174; 241/112; 118/652

[56] References Cited

U.S. PATENT DOCUMENTS

| | | | |
|---|---|---|---|
| 3,660,863 | 5/1972 | Gerbasi | 15/256.51 |
| 4,083,633 | 4/1978 | Shanly | 15/256.51 |
| 4,206,528 | 10/1980 | Klemz | 100/174 |
| 4,359,799 | 11/1982 | Boose | 100/174 |
| 4,451,140 | 5/1984 | Saito | 15/256.51 |
| 4,469,434 | 9/1984 | Yamazaki et al. | 15/256.51 |

*Primary Examiner*—Curtis R. Davis
*Assistant Examiner*—Sharon T. Cohen
*Attorney, Agent, or Firm*—Samuels, Gauthier, Stevens & Kehoe

[57] ABSTRACT

A doctor blade assembly has a doctor blade supported in a blade holder. The blade has a projecting front edge adapted to be placed in contact with a moving surface to be doctored, and a rear edge adapted to be received in the blade holder. The blade is preloaded in a manner such that tensile stresses are induced in the front edge thereof. The level of such tensile stresses is below the yield strength of the blade material, yet high enough to prevent compressive stresses from developing at the blade front edge as a result of heat being generated by frictional contact between the blade and the moving surface being doctored.

10 Claims, 2 Drawing Sheets

DOCTORING APPARATUS AND METHOD EMPLOYING PRESTRESSED DOCTOR BLADE

BACKGROUND OF THE INVENTION

1. Field of the Invention

This invention relates to an improvement in doctor blades and the use thereof in doctoring rotating cylinders, moving belts, plates and the like.

2. Description of the Prior Art

Doctoring is a well known procedure which is widely employed in a variety of industrial applications, including web processing, coating and printing, food processing, chemical processing, etc. In a typical doctoring operation, as shown for example in FIGS. 1 and 2, a blade holder 10 has cooperating jaws 12, 14 which define a slot 16 open at one end and closed at the opposite end by a base or seating surface 18. A doctor blade 20 is received in the slot 16. The blade has a front edge which projects from the holder and which is adapted to be applied against the surface to be doctored, which in the case illustrated is the surface 22 of a cylinder rotating in the direction indicated by arrow 24. The doctoring angle "x" may be obtuse, as illustrated, or it may be acute or perpendicular, depending on the overall design of the doctor assembly and the function to be performed by the blade. Typically, obtuse blade angles are used for cleaning and acute blade angles are used for wiping. A perpendicular blade angle is sometimes used for special creping operations.

The doctored surface 22 has a "face width" dimension "w" which is roughly equaled by the length "l" of the doctor blade. In many applications, the doctored surface 22 is essentially straight or flat, in which event the blade holder is normally provided with a straight construction which parallels the doctored surface. In some applications, however, the doctored surface may be crowned, requiring a similar crowning of the holder.

The doctor blades 20 are conventionally manufactured as flat elements, with straight parallel front and rear edges 20*a*, 20*b*. During normal operation, the blade is brought into contact with the surface 22 to be doctored and as shown in FIG. 3, an additional loading $L_A$ is applied, as required, to satisfactorily accomplish the intended function, which may for example be surface cleaning, web deflection and handling, creping, metering of inks or web coatings, etc.

As a result of the loading $L_A$, the doctored surface 22 exerts an equal but opposite force $L_O$ on the blade 20. Moreover, the movement of the surface being doctored generates a second force M which acts essentially perpendicular to force $L_O$. Force M is the sum of the useful work accomplished by the doctor blade and the frictional resistance to the relative movement between the doctored surface 22 and the front blade edge. The resultant of forces L and M is a force R which is oriented with respect to force M at an angle r.

As shown in FIG. 4, resultant force R may be resolved further into an axial force component P acting in the plane of the blade, and a transverse force component N acting normal to the blade. The sign (±) of transverse force N will change at angle $(r+b)=180°$, thereby signifying that any non-symmetrical blade holder should be inverted to increase proper operation.

The sign of axial force P undergoes a change at angle $(b+r)=90°$. Within the range of $(b+r)<90°$, force P acts to withdraw the blade from the bladeholder. In such situations, the blade must be restrained by clamping jaws, pins or the like.

Within the range of $(b+r)>90°$ (the condition illustrated in FIG. 4), force P acts to urge the blade into the holder and against the seating surface 18 at the base of the slot 16.

When a doctor blade 20 is loaded against the surface 22 being doctored, the blade acts as a friction brake which consumes power, and most of this power is converted into frictional heat. A portion of the friction heat warms the surface 22, another portion of the friction heat is dissipated into the surrounding air, the processing liquids if present, or the material being doctored, and still another portion of the friction heat warms the contacting surface at the front edge 20*a* of the doctor blade. The contacting surface of the blade thus becomes a heat source, and this heat is conducted rearwardly towards the rear blade edge 20*b*. However, because of radiation heat losses occurring at the exposed blade surface and additional heat losses due to conduction through the supporting jaws 12, 14 of the blade holder 10, the rear edge 20*b* of the blade is usually kept at a lower temperature than the front edge 20*a*. Thus, during a doctoring operation, there exists a temperature differential between the front and rear edges of the doctor blade.

As the temperature of the blade increases, the blade material will have a tendency to undergo linear expansion. However, because of the temperature differential between the front and rear edges, the front edge will expand more than the rear edge. If the blade were totally unrestrained, it would have a tendency to bow or arc outwardly at the midpoint of its length. However, as explained previously, when the blade is operating in the angular range of $(b+r)>90°$, axial force P urges the blade into the holder and against the seating surface 18, thereby supressing the tendency of the blade to bow or arc outwardly. The warmer front edge portion of the blade is thus not allowed to expand freely, but instead is forced into longitudinal compression. This is an unstable condition which leads to random buckling of the blade front edge. This condition is conventionally referred to as "blade edge heat ripple".

Pronounced blade edge heat ripple can substantially disrupt blade fit and/or uniformity of blade load distribution, which in turn can seriously disrupt the doctoring process. Conventionally, blade edge heat ripple is controlled by increasing load N (see FIG. 4). However, any increase in load N is unavoidably accompanied by a host of serious drawbacks, including increased generation of frictional heat, accelerated wear of the blade and doctored surface, and increased power consumption.

SUMMARY OF THE PRESENT INVENTION

The primary objective of the present invention is to eliminate blade edge heat ripple without increasing the load N, thereby making it possible to avoid the accompanying drawbacks mentioned above. This is accomplished by preloading the blade in a manner such that tensile stresses are induced in the front blade edge. The level of such tensile stresses is below the yield strength of the blade material, yet high enough to prevent compressive stresses from developing at the blade front edge as a result of heat being generated by frictional contact between the blade and the moving surface being doctored.

In a preferred embodiment of the invention to be described hereinafter in greater detail, the blade is manufactured with a predetermined magnitude of front and rear edge curvature, the front edge being concave and the rear edge being convex. After being inserted in a holder having a straight seating surface, the convex rear edge of the blade is forced against and into conformity with the straight seating surface, thereby setting up tensile stresses in the blade front edge and compressive stresses in the blade rear edge.

The geometry of the edge curvatures may be that of a simple bow or radius, a classic deflection curve, or any predetermined compounded shape suitable for any specific doctoring application.

As presently conceived for normal doctoring applications, the blade will have a constant width with parallel front and rear edges. However, for special applications, such as for example when the blade loading profile is to be varied across the doctored surface, the blade may have a varying width with front and rear edges displaying dissimilar curvatures.

Other objects, features and advantages of the present invention will now be described in greater detail with reference to the accompanying drawings, wherein:

DETAILED DESCRIPTION OF PREFERRED EMBODIMENT

Figure 5:
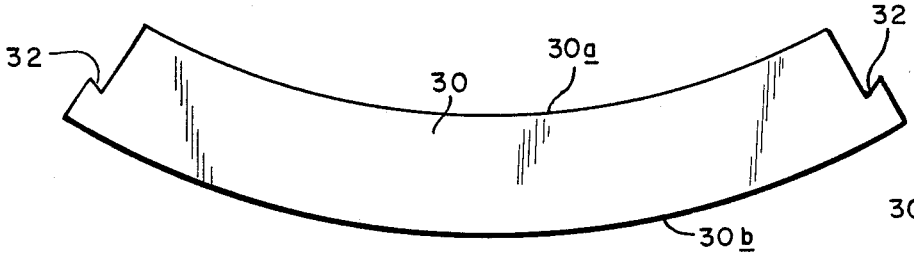
FIG. 5 is a plan view showing a blade in accordance with the present invention, with the degree of edge curvature exaggerated for purposes of illustration.
Figure 6:
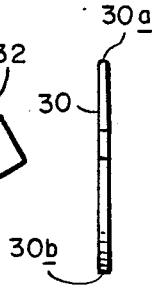
FIG. 6 is an end view of the blade shown in FIG. 5.

With reference to FIGS. 5 and 6, a doctor blade 30 in accordance with the present invention is shown as comprising an elongated flat element of substantially uniform width with a concave front edge 30*a* and a convex rear edge 30*b*. The front and rear edges are parallel to each other, their degrees of curvature having been exaggerated substantially for purposes of illustration. Notches 32 are provided adjacent the ends of the blade.

Figure 1:
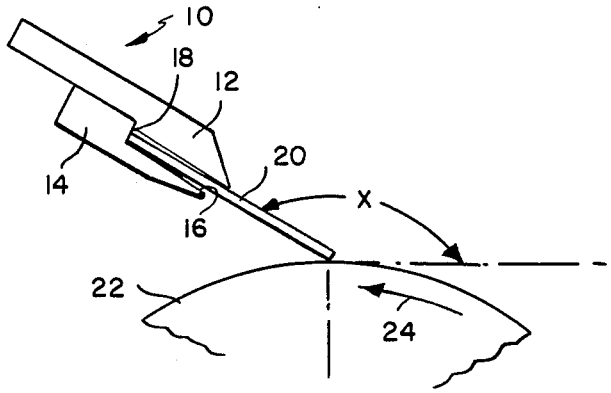
FIG. 1 is a diagrammatic illustration in side elevation of a doctor blade assembly.
Figure 2:
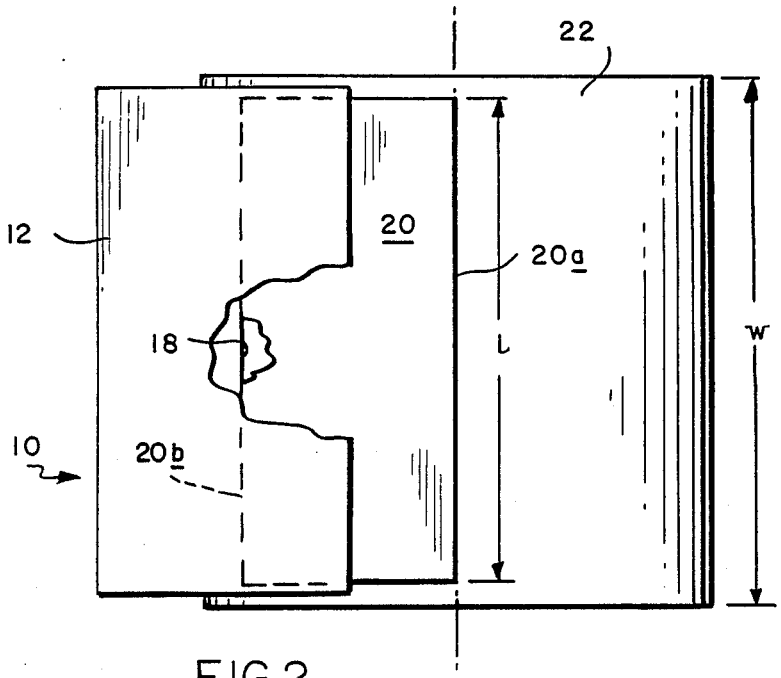
FIG. 2 is a partially broken away plan view of the doctor blade assembly shown in FIG. 1.
Figure 3:
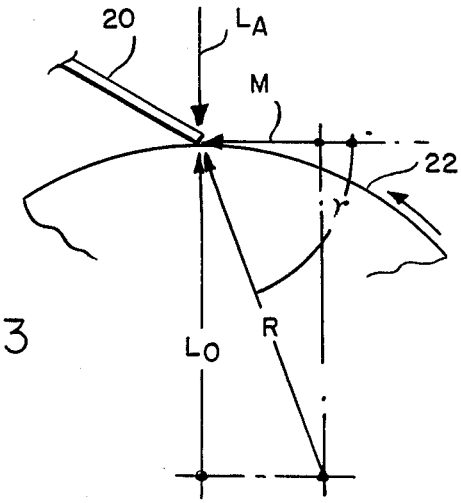
FIG. 3 is a diagram showing the forces to which the blade is exposed during a doctoring operation.
Figure 7:
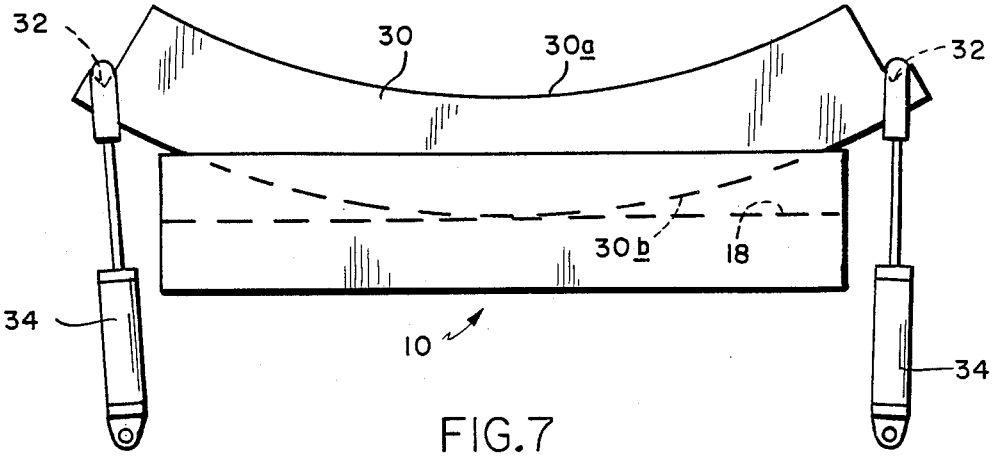
FIG. 7 is a plan view showing the blade of FIGS. 5 and 6 received in a blade holder at a stage prior to preloading.

As shown in FIG. 7, the blade 30 is adapted for insertion into the receiving slot of a blade holder 10 of the type shown in FIGS. 1 and 2, with the rear convex blade edge 30*b* extending along and adjacent to the blade holder's straight seating surface 18. At the stage shown in FIG. 7, the blade is unstressed, with the concave front edge 30*a* protruding outwardly from the holder.

Figure 8:
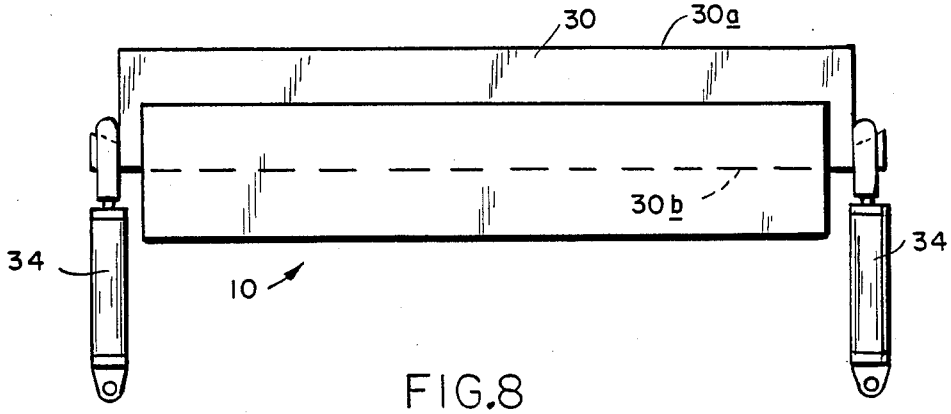
FIG. 8 is a view similar to FIG. 7 showing the blade after it has been subjected to preloading.

Conventional clamping assemblies, such as for example pneumatic piston-cylinder units 34 are then engaged with the ends of the blade by means of the notches 32. The piston-cylinder units 34 are then retracted, causing the convex rear edge 30*b* of the blade to be pulled against and into conformity with the straight seating surface 18 of the blade holder. As this occurs, the concave front edge 30*a* also undergoes straightening. The net result is that in the condition shown in FIG. 8, the blade has been preloaded to an extent such that tensile stresses are induced in the front edge 30*a*, and compressive stresses are induced in the rear edge 30*b*.

Figure 4:
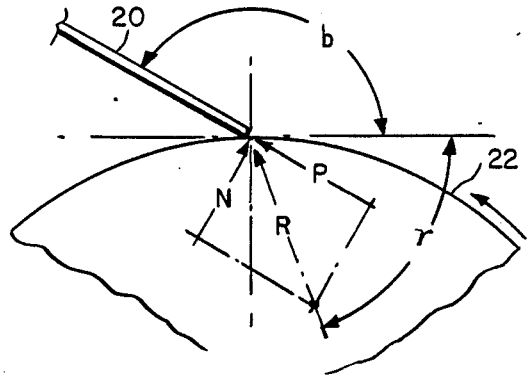
FIG. 4 is another force diagram.

When the thus prestressed blade is employed in doctoring, frictional blade edge heating does not produce compressive stress and resulting buckling instability or edge heat ripple, because the tendency to develop such compressive stresses merely acts to relieve the previously induced tensile prestresses. This result is achieved without increasing the blade loading N illustrated in FIG. 4. Thus, the generation of frictional heat is mimimized, as is wear of the blade and doctored surface, and power consumption. The level of tensile stresses induced in the front portion of the blade is kept within an appropriate range which is below the yield strength of the blade material, yet high enough to relieve any compressive stresses which might otherwise be induced as a result of frictional heating.

The tensioning or stretching of the front doctoring edge is also beneficial in that it acts to level any waviness or deviation from flatness which might have been imparted to the blade as a result of mishandling. Also, when the blade is being operated at an angle within the range of $(b+r)<90°$, the forces being exerted to urge the blade against seating surface 18 will resist any force tending to pull or drag the blade from the holder, thereby preserving the integrity of the initial blade fit and loading profile during subsequent doctoring.

In light of the foregoing description, it will now be appreciated by those skilled in the art that changes and modifications may be made to the disclosed embodiment without departing from the scope of the invention as defined by the claims hereinafter set forth. For example, other arrangements and techniques may be employed to achieve the desired level of tensile prestress in the forward blade edge. Also, under certain circumstances, it may be desirable to vary the width of the blade and to impart dissimilar curvatures to the front and rear edges.

I claim:

1. In the method of doctoring a moving surface by applying the elongate front edge of a doctor blade thereto while retaining the elongate rear edge of the blade in a blade holder, the improvement comprising: preloading the doctor blade to induce tensile and compressive stresses respectively in the front and rear edges thereof, said tensile and compressive stresses being oriented in the direction of blade length and the level of said tensile stresses being sufficient to prevent compressive stresses from developing at said front edge during doctoring as a result of linear expansion caused by frictional heat.

2. A doctor blade assembly comprising: a blade holder; an elongate doctor blade having front and rear edges extending along the blade length, said blade being dimensioned and configured to be received in and to be supported by said holder with said front edge projecting from said holder for frictional application to a moving surface to be doctored; and, means for preloading said blade in a manner such that tensile stresses are induced at said front edge in the direction of blade length, said tensile stresses being below the yield strength of said blade, yet high enough to counter the development of compressive stresses at said front edge as said front edge is heated by frictional contact with said moving surface during a doctoring operation.

3. The doctor blade assembly of claim 2 wherein as a result of said blade being preloaded, compressive stresses are induced in the rear edge thereof in the direction of blade length.

4. The doctor blade assembly of claim 3 wherein prior to being preloaded, said blade has a concave front edge and a convex rear edge.

5. The doctor blade assembly of claim 4 wherein prior to said blade being preloaded, said front and rear edges are substantially parallel.

6. The doctor blade assembly of either claims 3, 4 or 5 wherein said blade holder has a substantially straight seating surface, and wherein force exerting means are provided for urging the rear edge of said blade against and into conformity with said seating surface.

7. The doctor blade assembly of claim 6 wherein the front and rear edges of said blade are straightened as a result of said rear edge being urged against said seating surface by said force exerting means.

8. For use in doctoring a moving surface, a doctor blade assembly comprising:

a blade holder having a receiving slot defined at least in part by a substantially straight seating surface;

an elongate doctor blade dimensioned for insertion into said receiving slot, said doctor blade having a projecting front edge adapted to be placed in contact with said moving surface, and a rear edge adapted to be seated against said seating surface, said front and rear edges extending along the blade length and being respectively concave and convex when said blade is loosely received in said slot; and force exerting means associated with said blade holder for urging said rear edge against said seating surface in order to straighten said front and rear edges and thereby induce tensile and compressive stresses in the direction of blade length respectively in the front and rear edges of said blade.

9. A doctor blade comprising a flat elongate member having a front edge adapted to be applied to a moving surface to be doctored, and a rear edge adapted to be received in a blade holder, said front and rear edges extending along the blade length and being respectively concave and convex in the direction of blade length when said blade is unstressed.

10. Apparatus for doctoring a moving surface, comprising in combination:

an elongate flat doctor blade having front and rear edges extending along the blade length;

a holder for said blade, said holder having a slot for receiving the rear edge of said blade in a position such that the front edge of said blade projects from said holder for application to said moving surface; and means for preloading said blade to induce tensile stresses in the front edge thereof and compressive stresses in the rear edge thereof, said tensile and compressive stresses being oriented in the direction of blade length.

* * * * *